US005975717A

United States Patent [19]

Rahman

[11] Patent Number: 5,975,717

[45] **Date of Patent: *Nov. 2, 1999**

[54] CASCADE EFFECT ICICLE LIGHT SET

[75] Inventor: Najeh Rahman, Monsey, N.Y.

[73] Assignee: Minami International Corp., Yonkers, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/992,988

[22] Filed: Dec. 18, 1997

[51] Int. Cl.[6] ..... F21V 23/04

[52] U.S. Cl. ..... 362/251; 362/252; 362/227; 362/806

[58] Field of Search ..... 362/252, 122, 362/123, 249, 806, 227, 251; 315/185 S, 210

[56] References Cited

U.S. PATENT DOCUMENTS 4,417,182 11/1983 Weber ..... 315/210
4,870,547 9/1989 Crucefix .
5,379,202 1/1995 Daun .
5,747,940 5/1998 Openiano ..... 315/185

*Primary Examiner*—Sandra O'Shea
*Assistant Examiner*—Marshall Honeyman
*Attorney, Agent, or Firm*—Amster, Rothstein & Ebenstein

[57] ABSTRACT

A chaser icicle light set includes a transversely extending common wire portion, and a plurality of transversely spaced, parallel light strings depending from the common wire portion. Each light string defines a plurality of lamp sockets physically disposed in a series. The lamp sockets of the plurality of light strings are organized into a plurality of series-wired sets corresponding to given points along the lengths of the light strings. All lamp sockets of a given set within a given light string being electrically disposed in series. The number of the lamp sockets in each light string is an exact multiple of the number of sets. Controls for actuating and deactivating the sets successively produce a cascade wherein each set of each light string flashes on and off in substantially horizontal unison as a set to provide a chaser icicle effect.

3 Claims, 1 Drawing Sheet

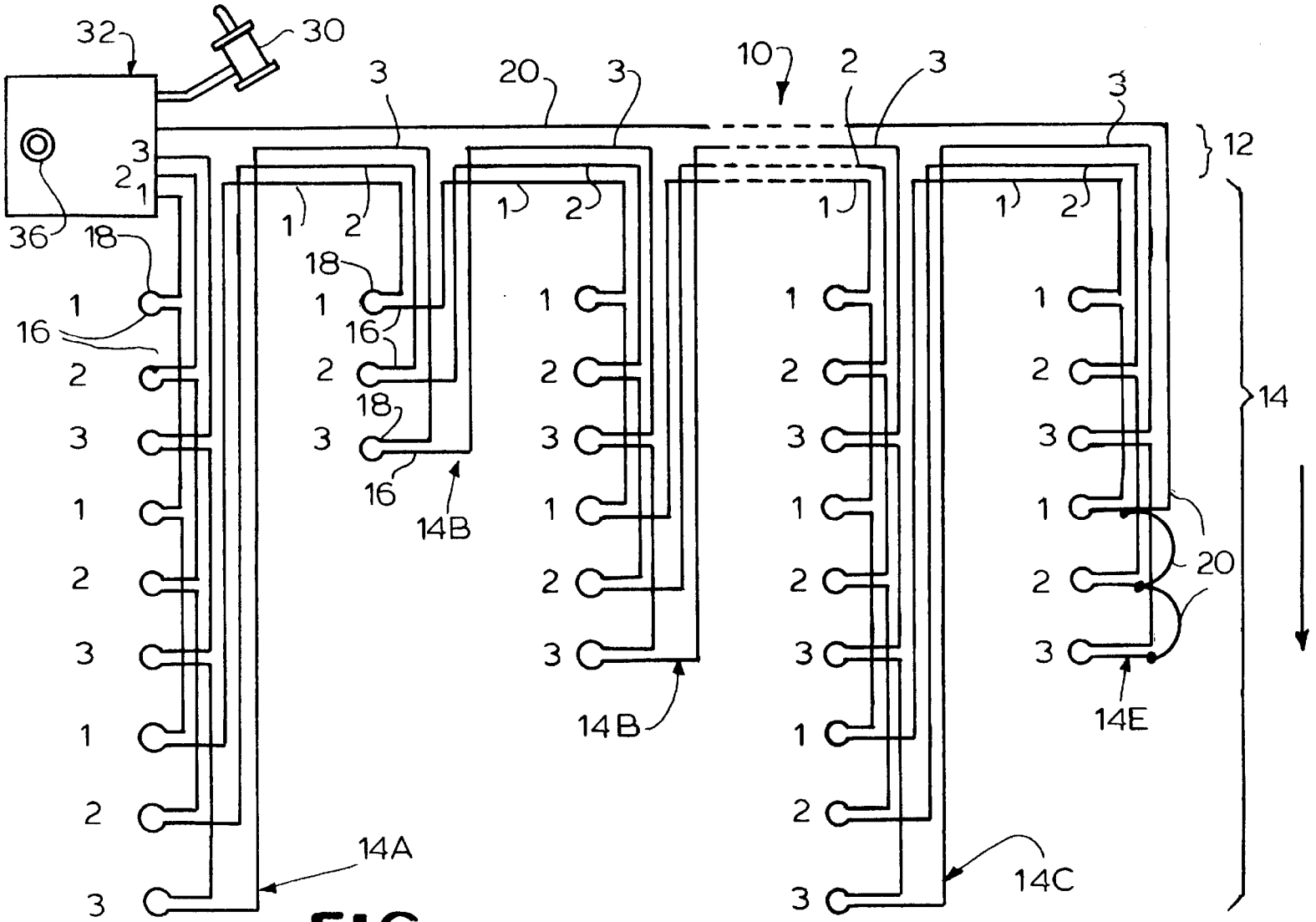
FIG.

CASCADE EFFECT ICICLE LIGHT SET

BACKGROUND OF THE INVENTION

The present invention relates an icicle effect light set, and more particularly a chaser icicle effect light set.

It is known to provide an "icicle" light set wherein there is a transversely extending common wire means at an upper portion of the light set and a plurality of transversely extending spaced parallel light strings descending from the common wire means like icicles. Each icicle contains a plurality of lamp sockets, and the icicles may be of different lengths containing 1, 2, 3, 4, etc. lamp sockets or they may be a common length containing a like plurality of lamp sockets. The lamps in each icicle may be activated and deactivated as a unit, typically independently of the lamps in the other icicles. The visual impression created by the known icicle light sets is not entirely satisfactory as it does not adequately portray the visual effect of melting icicles. Inherent in the concept of a melting icicle is the dripping or downward movement of the water from the top of the icicle to the bottom of the icicle. Thus, the need remains for a chaser icicle light set which will allow the lamps in each light string to be activated and deactivated in a downwardly moving or "chaser" pattern.

Accordingly, it is an object of the present invention to provide a chaser icicle light set.

Another object is to provide such a set wherein the lamps in each icicle (i.e., light string) create the visual effect of descending melted water.

A further object is to provide such a set wherein the first (highest) lamp of each icicle will turn on and off as a unit, followed by the second lamp of each icicle as a unit, followed by the third lamp of each icicle as a unit, etc.

SUMMARY OF THE INVENTION

It has been found that the above and related objects of the present invention are obtained in a cascade-effect icicle light set. The cascade-effect icicle effect light set comprises a transversely extending common wire means, and a plurality of transversely spaced parallel light strings depending from the common wire means. Each light string defines a plurality of lamp sockets physically disposed in a series, the lamp sockets of the plurality of light strings being organized into a plurality of series-wired sets corresponding to given points along the lengths of the light strings. Means are provided for activating and deactivating the sets successively to produce a cascade wherein each set of each light string flashes on and off substantially in horizontal unison as a set to provide a chaser icicle effect.

In a preferred embodiment, all lamp sockets of a given set within a given light string are electrically disposed in series. The number of lamp sockets in each light string is preferably an exact whole integer multiple of the number of sets.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 1 is a fragmentary circuit diagram of the chaser icicle light set of the present invention, the physical layout of the components thereof also being illustrated.

DETAILED DESCRIPTION OF THE PREFERRED EMBODIMENTS

Referring now to the drawing, and in particular to FIG. 1 thereof, therein illustrated is a circuit diagram of the chaser icicle light set according to the present invention, generally designated by the reference numeral 10, the physical layout of the components thereof also being illustrated. Depending upon the available voltage and the power consumption of the lamps used therein, the light set would typically have a 105, 140, 150 or some other quantity of icicle lights in motion. Preferred wiring is "22AWG, CXTW, 105C, UV RATED, VW-1".

The light set 10 comprises a transversely extending common wire means, generally designated 12, and a plurality of transversely spaced parallel light strings, generally designated 14. Each light string 14 defines a plurality of lamp sockets 16, each containing a lamp 18. It will be appreciated that the lamp sockets 16 of a given light string 14 are physically disposed in a series, but that they are not electrically disposed in series.

As illustrated, light string 14A has 9 lamps, 14B has 3 lamps, 14C has 6 lamps, 14D has 9 lamps, and 14E has 6 lamps. Although five light strings 14A–14E are shown, there may be fewer or more light strings in any given light set. As will also be clear to those skilled in the art, the number of lamps in each light string 14 may be varied from that illustrated, so long as the constraint noted below is observed.

The lamp sockets 16 of the various light strings 14 are organized into a plurality of series- wired sets 1, 2, 3 corresponding to given points along the lengths of the light strings and served, respectively, by active wires 1, 2, 3. As illustrated, there are three series-wired sets: set 1, set 2, and set 3. Thus in light string 14A, the active wire 1 is in electrical communication with each of the three lamp sockets 16 of set 1, the active wire 2 is in electrical communication with each of the three sockets of set 2, and the active wire of set 3 is in electrical communication with each of the three sockets of light set 3. Turning now to the light string 14B, the active wire of set 1 is in electrical communication with the first lamp socket 16 (set 1), the active wire 2 is in electrical communication with the second socket 16 (set 2), and the active wire 3 is in electrical communication with the third socket (set 3). The same type of analysis applies to light strings 14B–14E. Where there are 4 or more sets, additional active wires (not shown) to accommodate the extra sets are provided.

A control means, generally designated 32, is in electrical communication with a plug 30 inserted into a power supply (not shown). The control means 32 is preferably a conventional integrated circuit control which activates and deactivates the sets 1, 2, 3 successively to produce a cascade or waterfall effect wherein the lamps 18 of each set 1, 2, 3 of each light string 14A–14E flash on and off substantially in horizontal unison as a set to provide a chaser icicle effect. A preferred control means 32 is provided with means (such as rotatable knob 36) for varying the speed with which the lamps 18 of the various sets 1, 2, 3 in all light strings 12 are activated and deactivated in series, and preferably also for activating all the lamps 18 of all the sets 1, 2, 3 in all light strings 12 simultaneously. The control means 32 additionally receives the common ground wire 20 for the several sets (extending from the last light string 14 (here, 14E)). Thus, light string 14B has only one lamp 18 of each set, light strings 14C and 14E have two lamps of each set, and light strings of 14A and 14D have three lamps of each set. When the control means 32 energizes the active wires of sets 1, 2, and 3 successively, the topmost lamp 18 of each light string is briefly illuminated, 14 (i.e., set 1) followed by the second lamp 18 of each light string 14 (i.e., set 2), and finally followed by the third lamp 18 of each light string 14 (i.e., set 3). This produces the chasing effect in which the bulbs of the various sets are briefly lit in relatively swift succession.

In the case of each of light strings 14A and 14C–14E, there are multiple lamps 18 which will flicker on and off as each set 1, 2, 3 is in turn activated and deactivated by control means 32 because each of the lamp sockets 16 of a given set 1, 2, 3 within a given light string 14 is electrically disposed in series so the set is activated and deactivated as a unit. However, this does not destroy the chaser icicle effect because, at least for preferred chaser speeds, easily determined by adjustment of the knob 36 of control means 32, the illusion will be maintained. The illusion is modified in that, instead of an icicle dripping downwardly only from the top thereof, it will drip downwardly from various points along its lengths. The modified illusion created by a light string containing a greater number of lamps 18 than the number of sets may be considered to be more impressive and effective than that created by a shorter light string.

The number of lamp sockets 16 in each light string 14 is preferably an exact whole integer multiple of the number of series-wired sets—e.g., the multiplier is 1, 2, 3, etc. Thus, the number of lamp sockets 16 in light string 14B is three (equivalent to the three sets shown), the number of lamp sockets 16 in each of light strings 14C and 14E is six (twice the number of sets), and the number of lamp sockets 16 in each of light strings 14A and 14D is nine (three times the number of sets). The use of the number of lamps sockets in each light string being an exact whole integer multiple of the number of sets insures that the cascading effect is most pronounced since the first lamp in each light string will be part of series-wired set 1, the second will be part of series-wired set 2, and so forth. Consequently, when each series-wired set 1, 2, 3, is activated seriatim, the first lamp in each light string will become activated simultaneously. Also, the use of the same number of lamps in each series-wired set results in each lamp receiving the same voltage differential and burning with equal brightness. If there were more lamp sockets in a first set than in another set, the lamps 18 of the first set would not burn as brightly as the lamps 18 of the other set.

If the number of lamp sockets 16 in each light string 14 is not an exact whole integer multiple of the number of series-wired sets, it is still important that the first lamp of each light set be from set 1, the second lamp in each light string be from set 2, etc. This insures that the various lights of the various light strings will go on and off in substantially horizontal unison as a set to provide the chaser icicle effect.

The various wires connecting the control means 32 to the first light string 14A, the portions of the wires connecting, (i.e., intermediate) the light strings 14A–14E, and a major portion of the ground wire 20 (the portion being that illustrated as horizontal) are preferably twisted together or otherwise connected together at various points by connectors to form the transversely extending common wire means 12. The several wires 1, 2, 3 and 20 of the common wire means 12 may, illustrated as horizontal) are preferably twisted together or otherwise connected together at various points by connectors to form the transversely extending common wire means 12. The several wires 1, 2, 3 and 20 of the common wire means 12 may, alternatively or in addition thereto, be secured to a transversely extending support (not shown) affording greater rigidity than that provided by the common wire means 12 itself.

In summary, the present invention provides a chaser icicle lamp set wherein the lamps in each icicle (light string) create the visual effect of descending melted water because the first (highest) lamp of each icicle will turn on and off as a unit, followed by the second lamp of each icicle as a unit, followed by the third lamp of each icicle as a unit, etc.

Now that the present invention has been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A cascade-effect icicle light set comprising:

(A) a transversely extending common wire means;

(B) a plurality of transversely spaced parallel light strings depending from said common wire means, each light string being electrically and physically connected to an adjacent light string only by said common wire means at the tops thereof, each light string defining a plurality of lamp sockets physically disposed in a series, said lamp sockets of said plurality of light strings being organized into a plurality of series-wired sets corresponding to given points along the lengths of said light strings; and (C) means of activating and deactivating said sets successively to produce a cascade wherein successively each said set of each said light string flashes on and off substantially in horizontal unison as a set to provide a cascade-effect icicle light set.

2. The light set of claim 1 wherein all lamp sockets of a given set within a given light string are electrically disposed in series.

3. The light set of claim 1 wherein the number of said lamp sockets in each said light string is an exact whole integer multiple of the number of sets.

* * * * *